US009046815B2

(12) United States Patent
Kashimoto et al.

(10) Patent No.: US 9,046,815 B2
(45) Date of Patent: Jun. 2, 2015

(54) DEVELOPING DEVICE AND IMAGE FORMING APPARATUS PROVIDED THEREWITH

(71) Applicant: KYOCERA DOCUMENT SOLUTIONS INC., Osaka (JP)

(72) Inventors: Masahiro Kashimoto, Osaka (JP); Ryoji Nishimura, Osaka (JP); Hiroaki Ohashi, Osaka (JP); Takeshi Fujimura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 238 days.

(21) Appl. No.: 13/921,325

(22) Filed: Jun. 19, 2013

(65) Prior Publication Data

US 2013/0343786 A1 Dec. 26, 2013

(30) Foreign Application Priority Data

Jun. 26, 2012 (JP) ..... 2012-142703

(51) Int. Cl.

| | |
|---|---|
| ***G03G 15/09*** | (2006.01) |
| ***G03G 15/08*** | (2006.01) |
| ***G03G 21/20*** | (2006.01) |
| ***G03G 21/00*** | (2006.01) |

(52) U.S. Cl.

CPC ..... *G03G 15/0812* (2013.01); *G03G 21/206* (2013.01); *G03G 2215/0132* (2013.01)

(58) Field of Classification Search

CPC ..... G03G 15/0812; G03G 15/0898; G03G 21/206

USPC ..... 399/92, 98, 274, 284

See application file for complete search history.

(56) References Cited

FOREIGN PATENT DOCUMENTS

| | | | |
|---|---|---|---|
| JP | 2004-205999 | A | 7/2004 |
| JP | 2010-009030 | A | 1/2010 |
| JP | 2010-175882 | A | 8/2010 |
| JP | 2010-276954 | A | 12/2010 |

*Primary Examiner* — David Gray

*Assistant Examiner* — Andrew V Do

(74) *Attorney, Agent, or Firm* — Morgan, Lewis & Bockius LLP

(57) ABSTRACT

A developing device of the present disclosure includes a developing roller, a toner feeding roller, a regulating blade, a blade holding member, a toner receiving member, and a casing. The regulating blade regulates a thickness of toner carried on the toner feeding roller. An air flow path is formed inside the blade holding member. The toner receiving member, the regulating blade, and the blade holding member each include a slit hole that leads to the air flow path.

4 Claims, 7 Drawing Sheets

DEVELOPING DEVICE AND IMAGE FORMING APPARATUS PROVIDED THEREWITH

INCORPORATION BY REFERENCE

This application is based on Japanese Patent Application No. 2012-142703 filed on Jun. 26, 2012.

BACKGROUND

The present disclosure relates to a developing device and an image forming apparatus provided therewith, and in particular, to a developing device including a developing roller that feeds toner to an image carrying member, and a toner feeding roller that feeds toner to the developing roller, and to an image forming apparatus provided therewith.

In an electrophotographic image forming apparatus, an electrostatic latent image is formed on a peripheral surface of an image carrying member (a photosensitive drum) by irradiating the surface with light based on image information that is read from an original image or based on image information that is, for example, transmitted from an external device such as a computer, and the electrostatic latent image is developed into a toner image with toner fed from a developing device, and then, the toner image is transferred onto a sheet. The sheet that has undergone the transfer process then undergoes a fixing process, where the toner image is fixed thereon, and then the sheet is ejected to outside the apparatus.

Now, image forming apparatuses have recently come to have complicated structures to achieve, for example, color printing and increasingly high-speed processing, and the high-speed processing requires high-speed rotation of a toner stirring member inside the developing device. Specifically, with a developing method where a two-component developer including a magnetic carrier and toner is used with a magnetic roller (a toner feeding roller) to carry the developer and a developing roller to carry only the toner, in an opposing area where the developing roller and the magnetic roller face each other, only the toner is carried on the developing roller via a magnetic brush formed on the magnetic roller, and further, such part of the toner as has been left without being used for development comes off from the developing roller. This may cause the toner to be prone to float around the opposing portion where the developing roller and the magnetic roller face each other, and such toner accumulates in the vicinity of an ear cutting blade (a thickness regulating blade), and if the accumulated toner aggregates and adheres to the developing roller, it may lead to dropping of the toner and result in a defective image.

As a countermeasure, for example, there has been known the following developing device that uses a two-component developer including a magnetic carrier and toner, the developing device having a magnetic roller to carry the developer and a developing roller to carry only the toner. That is, an air inlet hole for taking-in air from outside the developing device is formed through a wall of a developing container, the wall facing the developing roller and the magnetic roller, and the developing roller and the magnetic roller are rotated, to thereby generate an air flow to make toner floating around an ear cutting blade move upward.

With this developing device, however, where the air flow is generated by rotating the developing roller and the magnetic roller, if the rollers stop rotating (when a developing operation is stopped), the air flow disappears. This allows the floating toner to fall due to its own weight to accumulate around the ear cutting blade.

The present disclosure has been made to solve the problems described above, and an object of the present disclosure is to provide a developing device capable of reducing accumulation of toner around a regulating blade, and an image forming apparatus provided therewith.

SUMMARY

According to an aspect of the present disclosure, a developing device includes a developing roller, a toner feeding roller, a regulating blade, a casing, a blade holding member, and a toner receiving member. The developing roller is arranged opposite to an image carrying member on which an electrostatic latent image is formed, and the developing roller feeds toner to the image carrying member in an opposing region where the developing roller and the image carrying member face each other. The toner feeding roller is arranged opposite to the developing roller, and the toner feeding roller feeds toner to the developing roller in an opposing region where the toner feeding roller and the developing roller face each other. The regulating blade is arranged below the opposing region where the developing roller and the toner feeding roller face each other, and the regulating blade is arranged opposite to the toner feeding roller at a predetermined distance from the toner feeding roller. The casing holds therein the developing roller, the toner feeding roller, and the regulating blade. The blade holding member is arranged below the regulating blade to extend along a longitudinal direction of the regulating blade, and the blade holding member holds the regulating blade. The toner receiving member is arranged over the regulating blade to extend along the longitudinal direction of the regulating blade, and the toner receiving member receives toner that falls from the developing roller. Inside the blade holding member, there is formed an air flow path for discharging air from inside the casing. The toner receiving member, the regulating blade, and the blade holding member each include a slit hole formed to extend along the longitudinal direction of the regulating blade and to lead to the air flow path.

Other objects and specific advantages of the present disclosure will become more apparent from the descriptions of embodiments set forth below.

DETAILED DESCRIPTION

Figure 1:
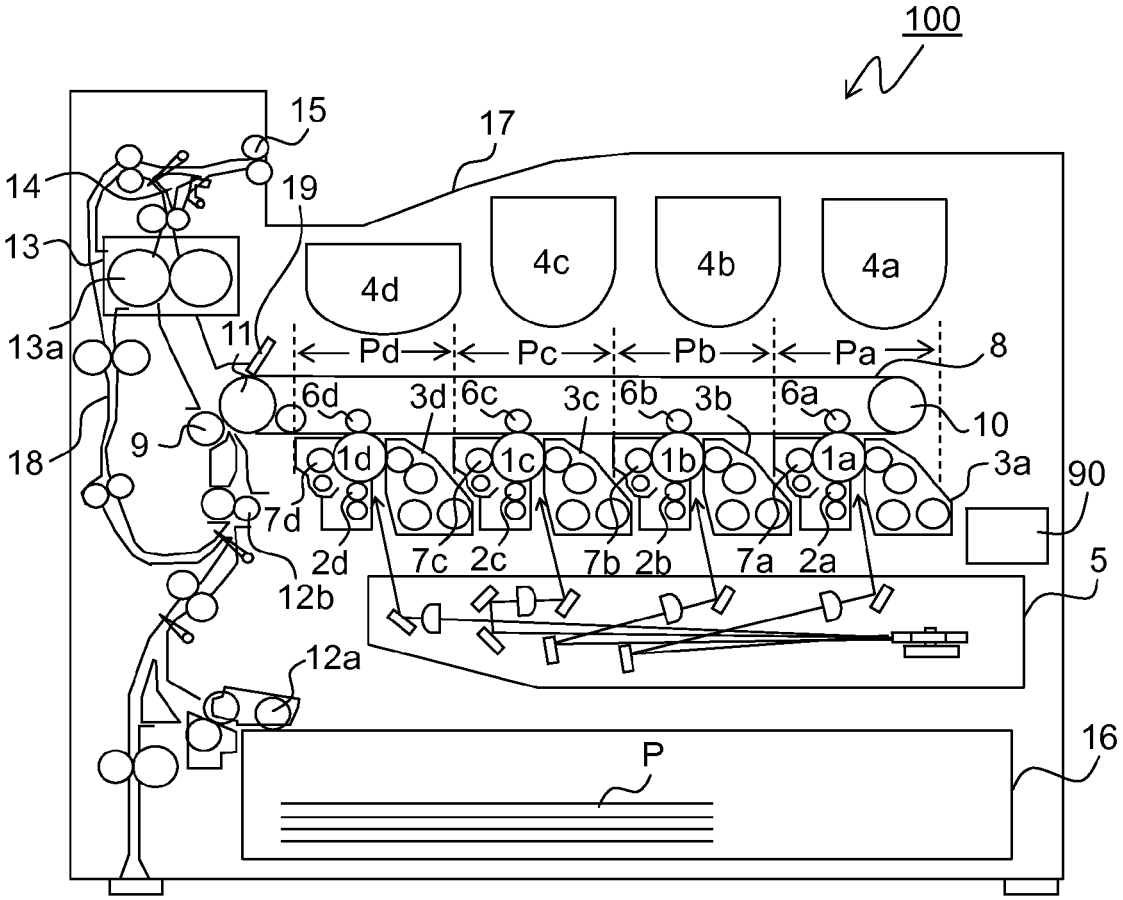
FIG. 1 is a sectional view schematically showing a structure of an image forming apparatus according to an embodiment of the present disclosure.

Embodiments of the present disclosure will be described below with reference to the accompanying drawings.

With reference to FIGS. 1 to 5, a description will be given of a structure of an image forming apparatus 100 according to an embodiment of the present disclosure. Inside a main body of the image forming apparatus 100 (here, a color printer), four image forming portions Pa, Pb, Pc, and Pd are arranged in this order from an upstream side in a transporting direction (right side in FIG. 1). These image forming portions Pa to Pd are disposed to form images of four different colors (cyan, magenta, yellow, and black), and the image forming portions Pa, Pb, Pc, and Pd sequentially form a cyan image, a magenta image, a yellow image, and a black image, respectively, through charging, exposure, developing, and transfer processes.

In the image forming portions Pa, Pb, Pc, and Pd, photosensitive drums (image carrying members) 1*a*, 1*b*, 1*c*, and 1*d*, are disposed, respectively, to each carry a visible image (a toner image) of a corresponding color. Furthermore, an intermediate transfer belt 8 that rotates clockwise in FIG. 1 by being driven by driving means (not shown) is provided adjacent to the image forming portions Pa to Pd. Toner images formed on the photosensitive drums 1*a* to 1*d* are sequentially primarily transferred onto the intermediate transfer belt 8 moving in contact with the photosensitive drums 1*a* to 1*d*, and the toner images are superimposed one on another on the intermediate transfer belt 8. Then, the toner images that have been primarily transferred onto the intermediate transfer belt 8 are secondarily transferred onto a transfer sheet P, which is an example of a recording medium, by action of a secondary transfer roller 9. Moreover, the toner images that have been secondarily transferred onto the transfer sheet P are fixed at a fixing portion 13, and then the transfer sheet P is ejected out of the main body of the image forming apparatus 100. While the photosensitive drums 1*a* to 1*d* are being rotated counterclockwise in FIG. 1, an image forming process is performed with respect to each of the photosensitive drums 1*a* to 1*d*.

The transfer sheet P onto which the toner images are to be secondarily transferred is put in a sheet cassette 16 that is arranged in a lower portion of the main body of the image forming apparatus 100, and the transfer sheet P is transported via a sheet feeding roller 12*a* and a registration roller pair 12*b* to a nip portion formed between the secondary transfer roller 9 and a later-described drive roller 11 that drives the intermediate transfer belt 8. The intermediate transfer belt 8 is made of a dielectric resin sheet, and the intermediate transfer belt 8 is typically formed as a (seamless) belt having no seam. Further, on a downstream side of the secondary transfer roller 9, a blade-shaped belt cleaner 19 is arranged for removing the toner and the like remaining on a surface of the intermediate transfer belt 8.

Next, the image forming portions Pa to Pd will be described. Around and below the rotatably disposed photosensitive drums 1*a* to 1*d*, there are provided: chargers 2*a*, 2*b*, 2*c*, and 2*d* for charging the photosensitive drums 1*a*, 1*b*, 1*c*, and 1*d*, respectively; an exposure device 5 for performing exposure with respect to the photosensitive drums a to 1*d* based on image information; developing devices 3*a*, 3*b*, 3*c*, and 3*d* for forming toner images on the photosensitive drums 1*a*, 1*b*, 1*c*, and 1*d*, respectively; and cleaning portions 7*a*, 7*b*, 7*c*, and 7*d* for removing developer (toner) and the like remaining on the photosensitive drums 1*a*, 1*b*, 1*c*, and 1*d*, respectively.

When image data is fed from a higher-level device such as a personal computer, the chargers 2*a* to 2*d* first charge surfaces of the photosensitive drums 1*a* to 1*d* uniformly, and then the exposure device 5 applies light according to the image data to form electrostatic latent images corresponding to the image data on the photosensitive drums 1*a* to 1*d*. The developing devices 3*a* to 3*d* are respectively filled with predetermined amounts of two-component developers respectively including cyan toner, magenta toner, yellow toner, and black toner. Note that, the developing devices 3*a*, 3*b*, 3*c*, and 3*d* are supplied with toner from toner containers (supply portions) 4*a*, 4*b*, 4*c*, and 4*d*, respectively, when a proportion of toner in each of the two-component developers present in the respective developing devices 3*a* to 3*d* is reduced to below a preset value as a result of later-described formation of toner images. The toner within the developers is supplied onto the photosensitive drums 1*a*, 1*b*, 1*c*, and 1*d* by the developing devices 3*a*, 3*b*, 3*c*, and 3*d*, respectively. Then, the toner electrostatically adheres to the respective photosensitive drums 1*a* to 1*d*, and thereby the toner images, which correspond to the electrostatic latent images formed by the exposure performed by the exposure device 5, are formed on the photosensitive drums a to 1*d*.

Then, by primary transfer rollers 6*a*, 6*b*, 6*c*, and 6*d*, an electric field is applied at a predetermined transfer voltage between the primary transfer rollers 6*a*, 6*b*, 6*c*, and 6*d* and the photosensitive drums 1*a*, 1*b*, 1*c*, and 1*d*, respectively, and the toner images of cyan, magenta, yellow, and black on the photosensitive drums 1*a* to 1*d* are primarily transferred onto the intermediate transfer belt 8. The images of these four colors are formed to have a predetermined positional relationship that is previously set for forming a predetermined full-color image. After that, in preparation for formation of new electrostatic latent images to be subsequently performed, the toner and the like remaining on the surfaces of the photosensitive drums 1*a*, 1*b*, 1*c*, and 1*d* after the primarily transfer are removed by the cleaning portions 7*a*, 7*b*, 7*c*, and 7*d*, respectively.

The intermediate transfer belt 8 is wound around a driven roller 10 on an upstream side and the drive roller 11 on a downstream side. When the intermediate transfer belt 8 starts to rotate clockwise in accordance with the rotation of the drive roller 11 caused by a drive motor (not shown), the transfer sheet P is transported from the registration roller pair 12*b* at a predetermined timing to a nip portion (a secondary transfer nip portion) between the drive roller 11 and the secondary transfer roller 9 provided adjacent to the drive roller 11, and a full-color toner image on the intermediate transfer belt 8 is secondarily transferred onto the transfer sheet P. The transfer sheet P onto which the toner images have been secondarily transferred is transported to the fixing portion 13.

At the fixing portion 13, heat and pressure are applied to the transported transfer sheet P by a fixing roller pair 13*a*, and the toner images are fixed onto a surface of the transfer sheet P to form the predetermined full-color image. The transfer sheet P on which the full-color image has been formed is directed toward one of a plurality of transporting directions branched from a branch portion 14. In a case where an image is formed on only one side of the transfer sheet P, the transfer sheet P is ejected as it is to an ejection tray 17 by an ejection roller pair 15.

On the other hand, in a case where images are formed on both sides of the transfer sheet P, the transfer sheet P that has passed through the fixing portion 13 is transported to a position where part of the transfer sheet P temporarily projects from the ejection roller pair 15 to outside the apparatus. Then, after a rear end of the transfer sheet P passes through the branch portion 14, the ejection roller pair 15 is rotated reversely, and a transporting direction at the branch portion 14 is switched. Thereby, the transfer sheet P is directed toward a sheet transport path 18 with its rear end at the head, and the transfer sheet P is transported again to the secondary transfer nip portion with its surface on which the image is formed reversed. Then, a next toner image formed on the intermediate transfer belt 8 is secondarily transferred by the secondary transfer roller 9 onto a surface of the transfer sheet P on which no image has been formed. Then, the transfer sheet P onto which the toner image has been secondarily transferred is transported to the fixing portion 13, where the toner image is fixed onto the transfer sheet P, and then the transfer sheet P is ejected to the ejection tray 17.

In addition, an air discharging fan (an air suction device) 90 is provided on a rear surface side of the main body of the image forming apparatus 100, and the air discharging fan 90 discharges air inside the main body of the image forming apparatus 100 to outside the apparatus main body.

Figure 2:
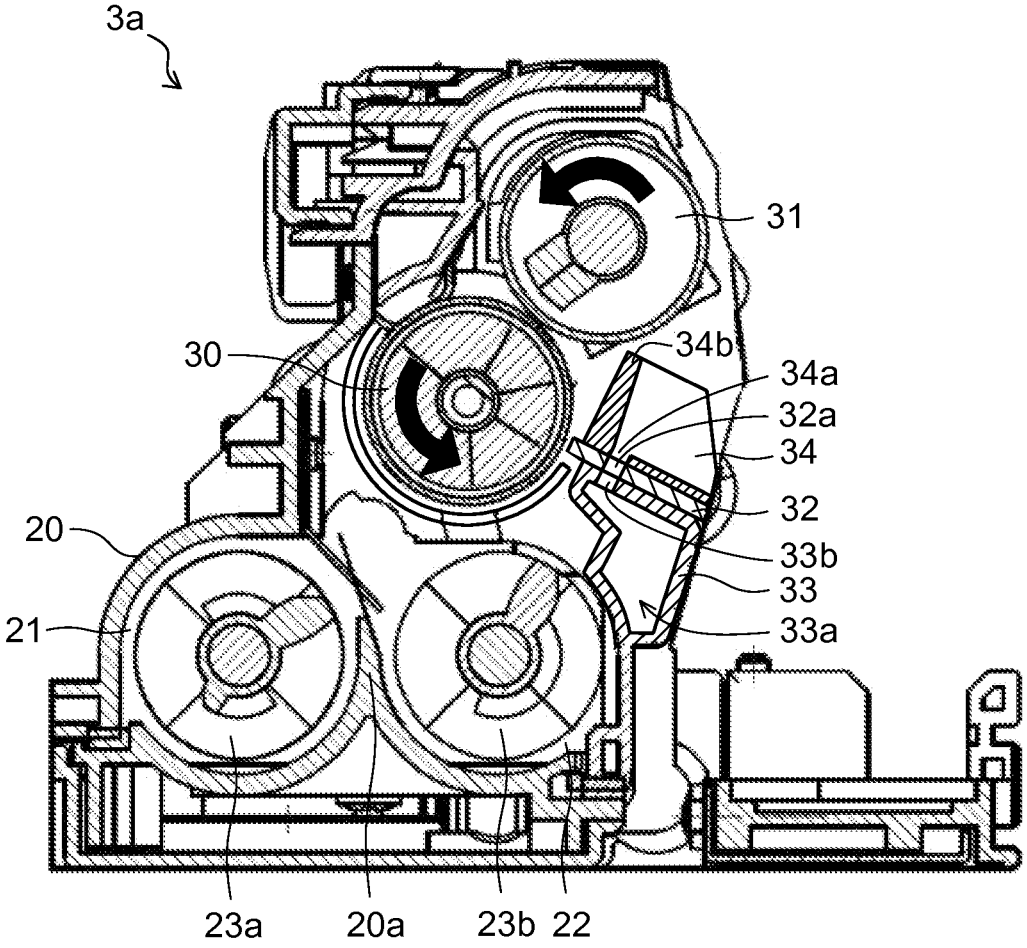
FIG. 2 is a side sectional view showing a structure of a developing device according to the embodiment of the present disclosure.

Next, with reference to FIG. 2, a detailed description will be given of a structure of the developing device 3*a*. Note that FIG. 2 illustrates the developing device 3*a* of FIG. 1 as viewed from a rear surface side of FIG. 1, and arrangement of the components in the developing device 3*a* is left-right reversal to that of FIG. 1. Further, in the following description, only the developing device 3*a* arranged in the image forming portion Pa of FIG. 1 is exemplified, and the developing devices 3*b* to 3*d* arranged in the image forming portions Pb to Pd are not described. This is because the developing devices 3*b* to 3*d* have basically the same structure as the developing device 3*a*.

As shown in FIG. 2, the developing device 3*a* includes a developing container (a casing) 20 for storing a two-component developer (hereinafter, simply referred to as developer), and the developing container 20 is separated by a partition wall 20*a* into a stirring-and-transporting chamber 21 and a feeding-and-transporting chamber 22. In the stirring-and-transporting chamber 21 and the feeding-and-transporting chamber 22, a stirring-and-transporting screw 23*a* and a feeding-and-transporting screw 23*b*, respectively, are rotatably disposed for mixing and stirring toner (positively charged toner) to be supplied from a toner container 4*a* (see FIG. 1) with a carrier so that the toner is charged.

Then, the developer is transported in an axial direction (a direction perpendicular to the sheet surface on which FIG. 2 is drawn) while being stirred by the stirring-and-transporting screw 23*a* and the feeding-and-transporting screw 23*b*, and circulates between the stirring-and-transporting chamber 21 and the feeding-and-transporting chamber 22 through developer passages (not shown) formed at both end portions of the partition wall 20*a*. That is, in the developing container 20, a developer circulation path is formed of the stirring-and-transporting chamber 21, the feeding-and-transporting chamber 22, and the developer passages.

The developing container 20 extends obliquely right upward in FIG. 2. Inside the developing container 20, a toner feeding roller 30 is arranged above the feeding-and-transporting screw 23*b*, and a developing roller 31 is arranged obliquely right above the toner feeding roller 30 to be opposite to the toner feeding roller 30. The developing roller 31 faces the photosensitive drum 1*a* (see FIG. 1) on an opening side of the developing container 20 (on the right side in FIG. 2). The toner feeding roller 30 and the developing roller 31 are rotated counterclockwise in FIG. 2 about respective rotation shafts thereof.

In the stirring-and-transporting chamber 21, an unillustrated toner concentration sensor is arranged to face the stirring-and-transporting screw 23*a*. Based on detection results of the toner concentration sensor, the stirring-and-transporting chamber 21 is supplied with toner from the toner container 4*a* through an unillustrated toner supply port. As the toner concentration sensor, for example, there is used a magnetic permeability sensor for detecting magnetic permeability of the two-component developer in the developing container 20, the two-component developer including the toner and a magnetic carrier.

The toner feeding roller 30 is a magnetic roller formed of a non-magnetic rotary sleeve that rotates counterclockwise in FIG. 2, and a fixed magnet that is enclosed in the rotary sleeve and that has a plurality of magnetic poles.

The developing roller 31 is formed of a cylindrical developing sleeve that rotates counterclockwise in FIG. 2, and a developing roller side magnetic pole fixed in the developing sleeve. The toner feeding roller 30 and the developing roller 31 face each other at a facing position (an opposing position) with a predetermined gap therebetween. The developing roller side magnetic pole has a polarity that is opposite to a polarity of one of the magnetic poles of the fixed magnet (main pole), the one being to face the developing roller side magnetic pole.

Further, the developing container 20 is provided with a ear cutting blade (a regulating blade) 32 that regulates a thickness of the developer carried on the toner feeding roller 30. The thickness regulating member 32 is attached along a longitudinal direction of the toner feeding roller 30 (a direction perpendicular to the sheet surface on which FIG. 2 is drawn). In a rotation direction of the toner feeding roller 30 (a counterclockwise direction in FIG. 2), the ear cutting blade 32 is positioned on an upstream side of the opposing position where the developing roller 31 and the toner feeding roller 30 face each other. Further, the ear cutting blade 32 is arranged below an opposing portion (an opposing region) where the developing roller 31 and the toner feeding roller 30 face each other. A slight space (a gap) is formed between surfaces of the thickness regulating member 32 and the toner feeding roller 30.

To the developing roller 31, a direct-current voltage (hereinafter, referred to as Vslv (DC)) and an alternating-current voltage (hereinafter, referred to as Vslv (AC)) are applied. To the toner feeding roller 30, a direct-current voltage (hereinafter, referred to as Vmag (DC)) and an alternating-current voltage (hereinafter, referred to as Vmag (AC)) are applied. These DC voltages and AC voltages are applied to the developing roller 31 and the toner feeding roller 30 from a developing-bias power supply via a bias control circuit (neither is illustrated).

As described above, the developer circulates in the stirring-and-transporting chamber 21 and the feeding-and-transporting chamber 22 inside the developing container 20 while being stirred by the stirring-and-transporting screw 23*a* and the feeding-and-transporting screw 23*b* to thereby charge the toner included in the developer. The developer in the feeding-and-transporting chamber 22 is transported to the toner feeding roller 30 by the feeding-and-transporting screw 23*b*. Then, a magnetic brush (not shown) is formed on the toner feeding roller 30. The magnetic brush on the toner feeding roller 30 is regulated in layer thickness by the ear cutting blade 32, and then transported by rotation of the toner feeding roller 30 to the opposing portion where the toner feeding roller 30 and the developing roller 31 face each other. In this way, a thin toner layer is formed on the developing roller 31 by means of a potential difference ΔV between Vmag (DC) applied to the toner feeding roller 30 and Vslv (DC) applied to the developing roller 31, and a magnetic field.

A thickness of the toner layer on the developing roller 31 varies depending on factors such as resistance of the developer and a difference in rotation speed between the toner feeding roller 30 and the developing roller 31, and the thickness is able to be controlled by means of ΔV. The toner layer on the developing roller 31 becomes thick if ΔV is increased, while the toner layer on the developing roller 31 becomes thin if ΔV is reduced. An appropriate range of ΔV at the time of development is typically approximately from 100 V to 350 V.

The thin toner layer formed on the developing roller 31 by means of contact with the magnetic brush on the toner feeding roller 30 is transported to an opposing portion (an opposing region) where the photosensitive drum 1*a* and the developing roller 31 face each other. To the developing roller 31, Vslv (DC) and Vslv (AC) are applied, and hence potential difference between the developing roller 31 and the photosensitive drum 1*a* causes the toner to fly from the developing roller 31 to the photosensitive drum 1*a*, to develop the electrostatic latent image on the photosensitive drum 1*a*.

Toner remaining without being used for development is transported again to the opposing portion where the developing roller 31 and the toner feeding roller 30 face each other, and is collected by the magnetic brush formed on the toner feeding roller 30. Then, the magnetic brush comes off from a portion of the toner feeding roller 30 having the same polarity as the fixed magnet, and then drops into the feeding-and-transporting chamber 22.

After that, based on detection results of the toner concentration sensor (not shown), a predetermined amount of toner is supplied through the toner supply port (not shown), to regenerate the two-component developer that is uniformly charged at an appropriate toner concentration while being circulated between the feeding-and-transporting chamber 22 and the stirring-and-transporting chamber 21. The developer is fed again onto the toner feeding roller 30 by the feeding-and-transporting screw 23*b* so as to form a magnetic brush, which is transported to the ear cutting blade 32.

Figure 3:
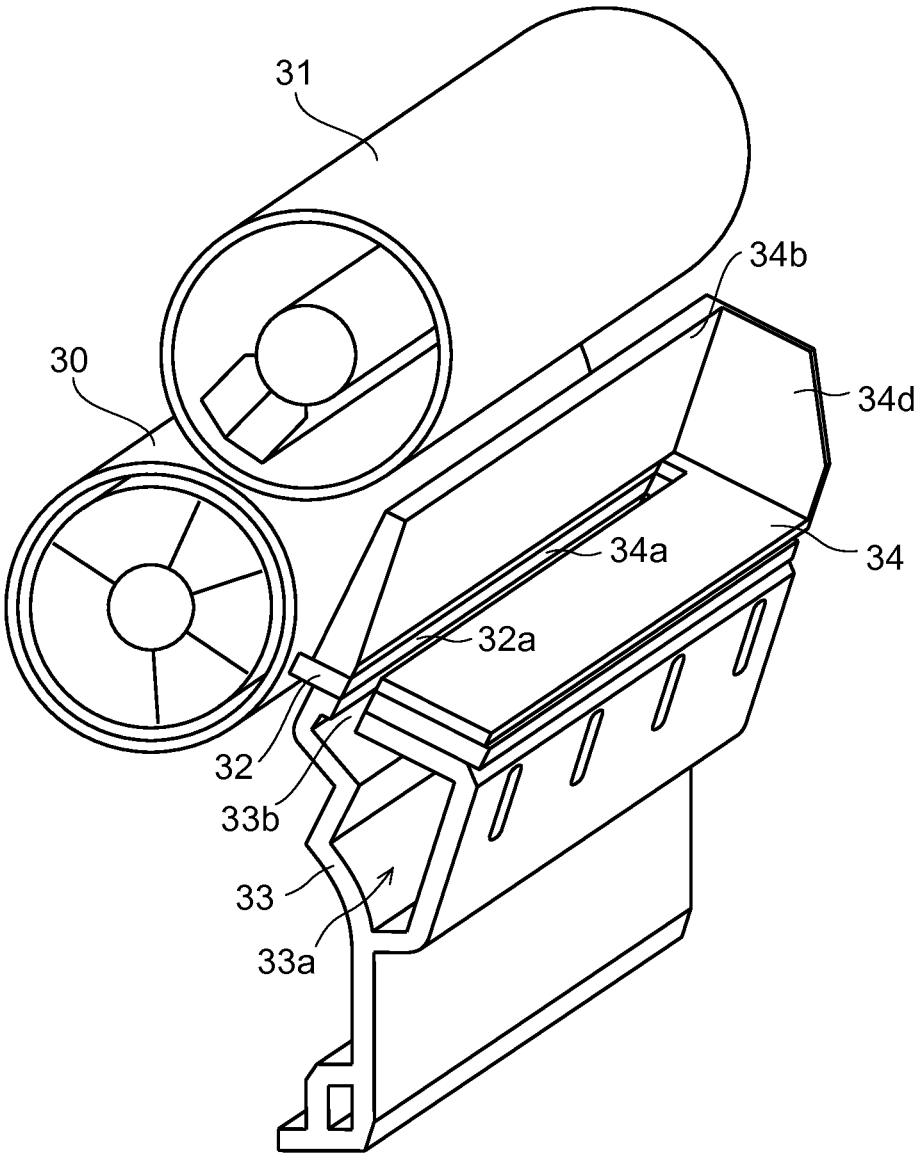
FIG. 3 is a sectional perspective view showing a structure around an ear cutting blade in the developing device according to the embodiment of the present disclosure.

The ear cutting blade 32 is formed of a magnetic material such as a magnetic metal sheet and a magnet. Under the ear cutting blade 32, there is provided a blade holding member 33 that holds the ear cutting blade 32, and over the ear cutting blade 32, there is provided a toner receiving member 34 that receives toner falling from the developing roller 31. As shown in FIG. 3, the blade holding member 33 and the toner receiving member 34 are formed to extend along a longitudinal direction of the ear cutting blade 32.

Inside the blade holding member 33, there is formed an air flow path 33*a* that extends along a longitudinal direction of the blade holding member 33, and air flows through the air flow path 33*a*. The air flow path 33*a* leads to the air discharging fan 90 (see FIG. 1) via an unillustrated duct, to discharge air from inside the developing container 20 to outside the developing container 20. With this structure, by air flowing through the air flow path 33*a*, heat generated at the ear cutting blade 32 and conveyed to the blade holding member 33 is efficiently dissipated from the blade holding member 33.

The blade holding member 33, the ear cutting blade 32, and the toner receiving member 34 include slit holes 33*b*, 32*a*, and 34*a*, respectively, which are formed in the toner feeding roller 30 side parts thereof, and which lead to the air flow path 33*a*. The slit holes 33*b*, 32*a*, and 34*a* are formed to extend substantially all along the longitudinal direction of the ear cutting blade 32. Note that the slit holes 33*b*, 32*a*, and 34*a* may each be divided into a plurality of sections along the longitudinal direction of the ear cutting blade 32.

Figure 4:
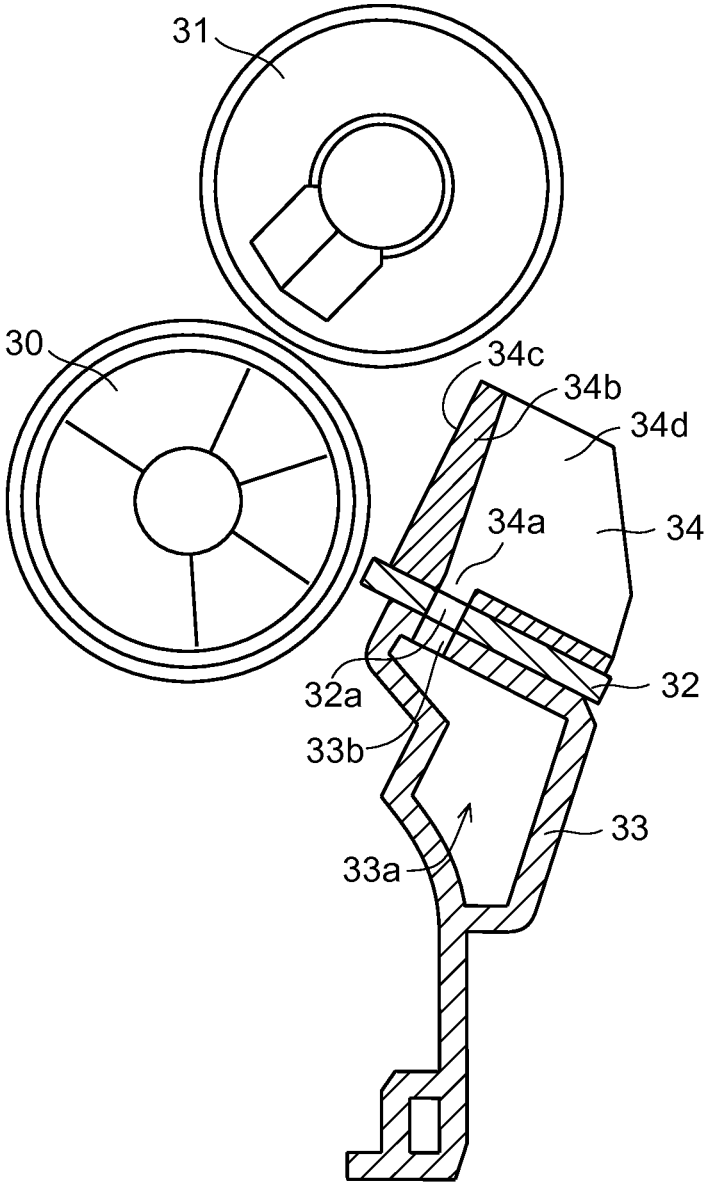
FIG. 4 is a side sectional view showing the structure around the ear cutting blade in the developing device according to the embodiment of the present disclosure.

As shown in FIG. 4, at an end part of the toner receiving member 34 on the toner-feeding-roller-30 side, there is provided a wall portion 34*b* that inclines such that a lower part thereof is closer to the toner feeding roller 30. That is, the wall portion 34*b* is provided closer to the toner feeding roller 30 than the slit hole 34*a* of the toner receiving member 34 is. Besides, the wall portion 34*b* is formed along the longitudinal direction of the toner receiving member 34 to project from the toner feeding roller 30-side end of the toner receiving member 34 so as to project upward along the longitudinal direction of the toner receiving member 34. In addition, the wall portion 34*b* is formed adjacent to the slit hole 34*a*.

The wall portion 34*b* includes an inclined surface 34*c* that faces the toner feeding roller 30, and the inclined surface 34*c* is formed substantially perpendicular with respect to an upper surface of the ear cutting blade 32. In addition, at both ends of the toner receiving member 34 in its longitudinal direction, wall portions 34*d* are provided.

Figure 5:
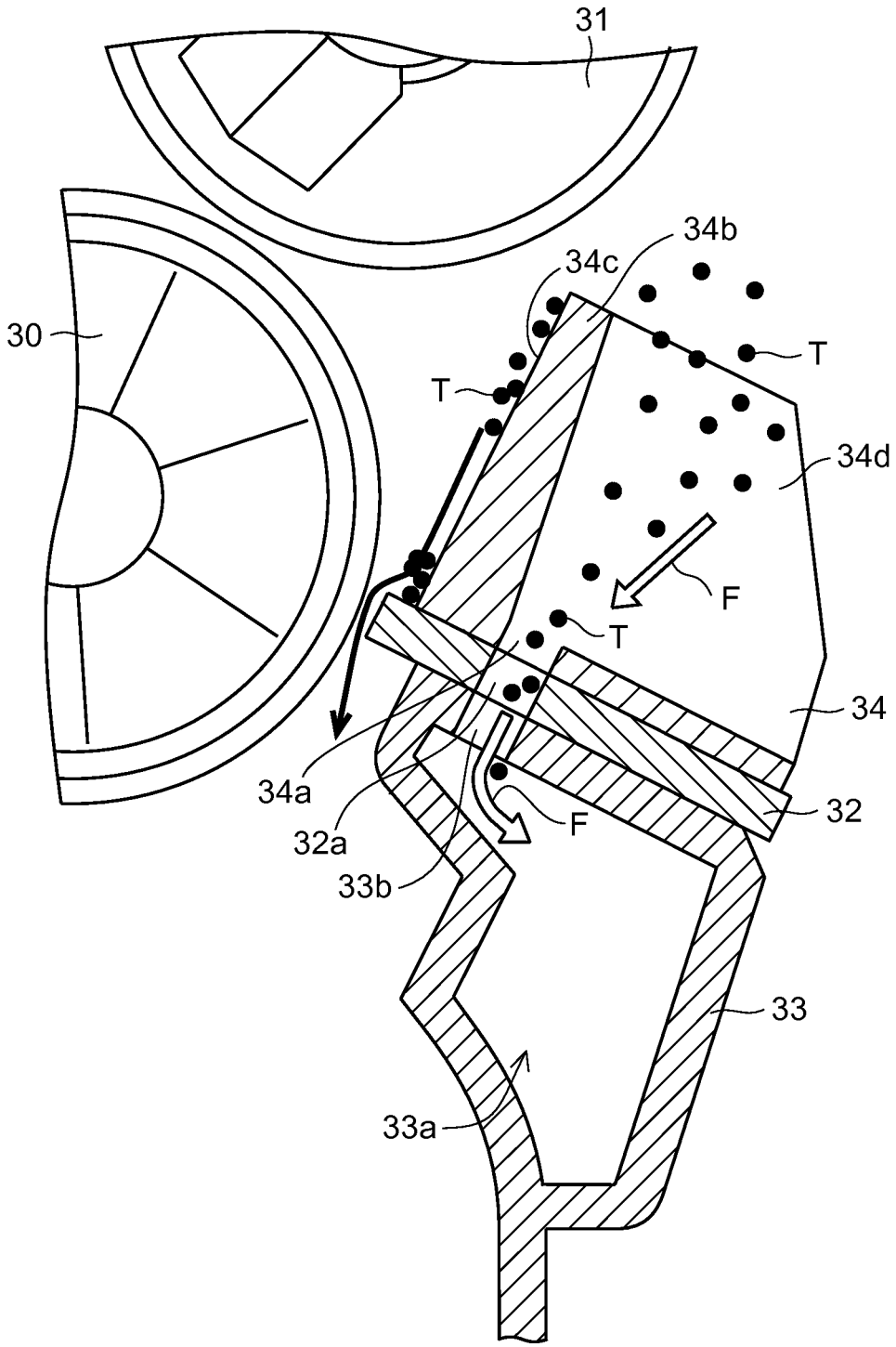
FIG. 5 is a side sectional view showing the structure around the ear cutting blade in the developing device according to the embodiment of the present disclosure.

As shown in FIG. 5, toner T falling from the developing roller 31 drops onto the toner feeding roller 30 side of the wall portion 34*b*, or onto a side of the wall portion 34*b* opposite to the toner feeding roller 30 side of the wall portion 34*b*.

Here, the air flow path 33*a* leads to the air discharging fan 90 (see FIG. 1), and there is a negative pressure inside the air flow path 33*a*, and as a result, an air flow F is generated to flow from a region above the toner receiving member 34 and opposite to the toner feeding roller 30, via the slit holes 34*a*, 32*a*, and 33*b* into the air flow path 33*a*. The air flow F directs the toner T falling to the side of the wall portion 34*b* opposite to the toner feeding roller 30 side of the wall portion 34*b* into the air flow path 33*a*, to be then transported via the unillustrated duct to the air discharging fan 90. The toner T is caught by an unillustrated filter provided at the air discharging fan 90, so that air that does not include the toner T is discharged to the outside.

On the other hand, the toner T dropped onto the toner feeding roller 30 side of the wall portion 34*b* slides down the inclined surface 34*c* of the wall portion 34*b*, to pass through a space between the ear cutting blade 32 and the toner feeding roller 30, and falls into the feeding-and-transporting chamber 22.

According to the present embodiment, as described above, inside the blade holding member 33, the air flow path 33*a* is formed to lead to the air discharging fan 90 via which air inside the developing device 20 is discharged to outside the developing device 20. The toner receiving member 34, the ear cutting blade 32, and the blade holding member 33 includes the slit holes 34*a*, 32*a*, and 33*b*, respectively, which each extend along the longitudinal direction of the ear cutting blade 32 and lead to the air flow path 33*a*. In this structure, there is a negative pressure inside the air flow path 33*a*, so that the air flow F, which flows into the air flow path 33*a* from outside via the slit holes 34*a*, 32*a*, and 33*b*, is generated. This makes it possible to direct the toner falling from the developing roller 31 into the air flow path 33*a*, and thus to reduce accumulation of the toner around the ear blade 32. As a result, it is possible to reduce adhesion of accumulated and aggregated toner onto the developing roller 31, and thus, it is possible to reduce defective images.

Further, since the air flow path 33*a* leads to the air discharging fan 90 as described above, the air flow F does not disappear even when the developing roller 31 and the toner feeding roller 30 are stopped (that is, when a developing operation is stopped). This makes it possible to reduce accumulation of the toner, whether or not the developing roller 31 and the toner feeding roller 30 are rotating or not (that is, whether or not the developing operation is being performed).

Further, in contrast to the above-described conventional developer where toner is forced into an air flow flowing upward against the weight of the toner itself, the toner is forced into the air flow that flows downward in the present embodiment, and thus, it is easy to force the toner into the air flow, and this makes it possible to significantly reduce accumulation of the toner.

Further, as described above, since the toner receiving member 34 is provided with a wall portion 34*b* that is formed at a position closer to the toner feeding roller 30 than the slit hole 34*a* is, it is possible to limit air to be sucked into the air flow path 33*a*. That is, air on the toner feeding roller 30 side with respect to the wall portion 34*b* is not sucked into the air flow path 33*a*, and only air on the side opposite from the toner feeding roller 30 with respect to the wall portion 34*b* is sucked into the air flow path 33*a*. Thereby, it is possible to increase the speed of the air flow that flows into the air flow path 33*a* from outside, and thus, to achieve improved suction performance. In addition, since the toner on the toner feeding roller 30 side with respect to the wall portion 33*a* is not sucked into the air flow path 33*a*, and thus, it is possible to allow only a minimum necessary amount of toner to be sucked into the air flow path 33*a*.

Further, as described above, the surface (the inclined surface 34*c*) of the wall portion 34*b* facing the toner feeding roller 30 inclines such that a lower part thereof is closer to the toner feeding roller 30. Thereby, it is possible to reduce accumulation of the toner on the surface (the inclined surface 34*c*) of the wall portion 34*b* facing the toner feeding roller 30. This makes it possible to further reduce accumulation of the toner around the ear cutting blade 32.

Further, the provision of the slit holes 34*a*, 32*a*, and 33*b* in the toner feeding roller 30 side parts of the toner receiving member 34, the ear cutting blade 32, and the blade holding member 33, respectively, makes it possible to further reduce adhesion of the toner on the toner feeding roller 30 and the developing roller 31.

The embodiments disclosed herein are to be considered in all respects as illustrative and not restrictive. The scope of the present disclosure is set out in the appended claims and not in the descriptions of the embodiments hereinabove, and includes any variations and modifications within the sense and scope equivalent to those of the claims.

For example, although there have been described cases where the present disclosure is applied to a tandem color image forming apparatus as shown in FIG. 1, this is not meant to limit the present disclosure. The present disclosure is applicable, as a matter of course, to various image forming apparatuses such as a monochrome copying machine, a monochrome printer, a digital multifunction peripheral, a facsimile, etc. having a developing device including a developing roller and a toner feeding roller.

Further, the above-described embodiments each exemplify a case where an air discharging fan is used as an air suction device, but this is not meant to limit the present disclosure, and an air suction device other than an air discharging fan may be used. Further, each developing device may be provided with an air suction device.

Further, the above-described embodiments each exemplify a case where the blade holding member and the toner receiving member are provided inside the developing container, but this is not meant to limit the present disclosure, and the blade holding member or the toner receiving member may form part of the developing container.

Figure 6:
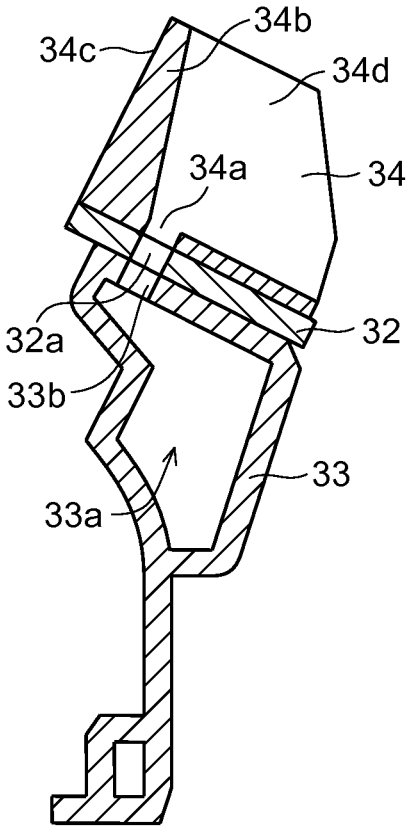
FIG. 6 is a side sectional view for illustrating a structure of a toner receiving member according to a first modified example of the present disclosure.

Further, the toner receiving member 34 may be structured as shown in FIG. 6. That is, the wall portion 34*b* of the toner receiving member 34 may be formed so as to cover the toner feeding roller 30 side part of the upper surface of the ear cutting blade 32. With this structure, it is possible to further reduce accumulation of the toner on the upper surface of the ear cutting blade 32.

Figure 7:
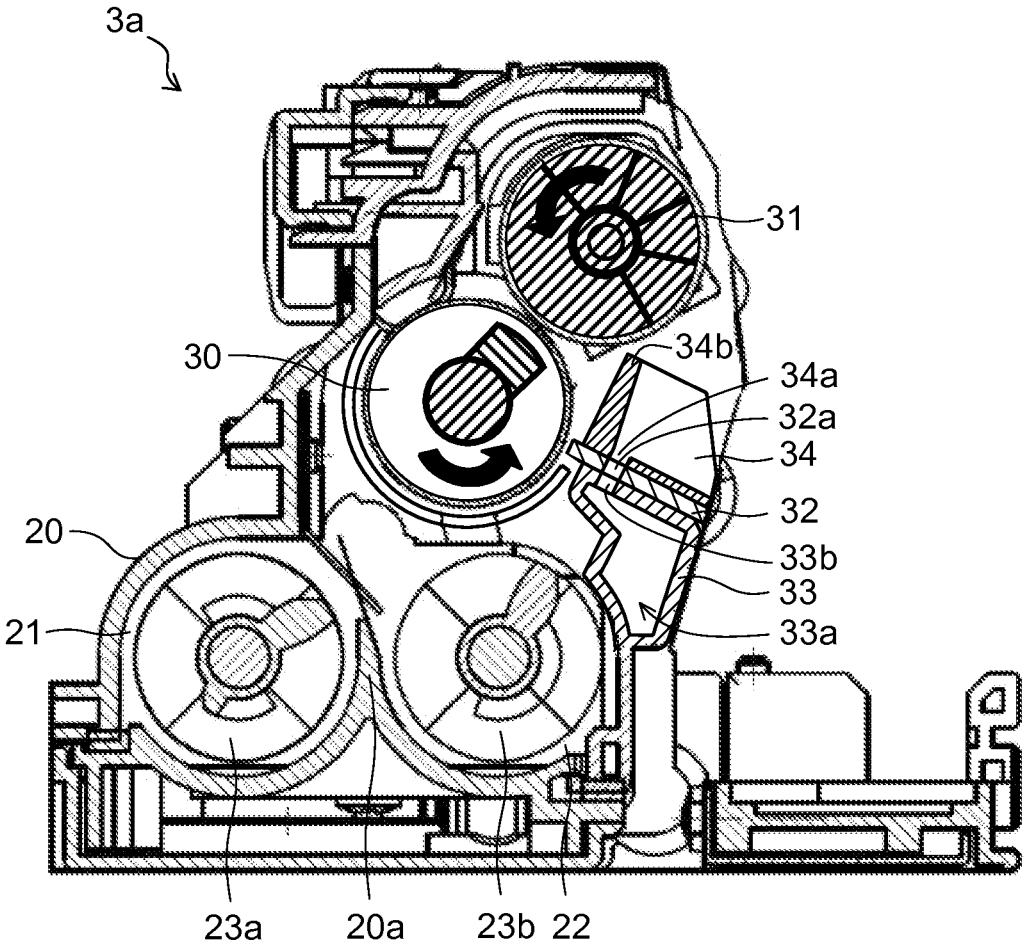
FIG. 7 is a side sectional view showing a structure of a developing device according to a second modified example of the present disclosure.

Further, in the above-described embodiments, the present disclosure is applied to the developing devices 3*a* to 3*d* that each use a two-component developer to form a magnetic brush on the toner feeding roller 30, only the toner being allowed to move from the toner feeding roller 30 to the developing roller 31, the toner being fed from the developing roller 31 to the photosensitive drums 1*a* to 1*d*, but this is not meant to limit the present disclosure. For example, the present disclosure is applicable to such a developing device as shown in FIG. 7, having the following structure; a developing roller 31 and a toner feeding roller 30 are arranged opposite to the above-described embodiments, toner is fed to each of photosensitive drums 1*a* to 1*d* by means of a magnetic brush of a two-component developer held on the surface of the developing roller 31 (which, in this structure, is a magnetic roller having the same structure as the toner feeding roller 30 of the above-described embodiments), the toner held on the surface of the toner feeding roller 30 (which, in the present structure, has the same structure as the developing roller 31 of the above-described embodiments) is fed to the developing roller 31, and residual toner remaining on the surface of the developing roller 31 is collected by means of the toner feeding roller 30. With this structure as well, it is possible to reduce accumulation of the toner around the ear cutting blade 32.

What is claimed is:

1. A developing device, comprising:

a developing roller arranged opposite to an image carrying member on which an electrostatic latent image is formed, the developing roller being configured to feed toner to the image carrying member in an opposing region where the developing roller and the image carrying member face each other;

a toner feeding roller arranged opposite to the developing roller, the toner feeding roller being configured to feed toner to the developing roller in an opposing region where the toner feeding roller and the developing roller face each other;

a regulating blade arranged opposite to the toner feeding roller at a predetermined distance from the toner feeding roller, below the opposing region where the developing roller and toner feeding roller face each other;

a casing that holds therein the developing roller, the toner feeding roller, and the regulating blade;

a blade holding member arranged under the regulating blade to extend along a longitudinal direction of the regulating blade, the blade holding member being configured to hold the regulating blade; and a toner receiving member arranged over the regulating blade to extend along the longitudinal direction of the regulating blade, the toner receiving member being configured to receive toner that falls from the developing roller, wherein an air flow path for discharging air from inside the casing is formed inside the blade holding member, and the toner receiving member, the regulating blade, and the blade holding member each include a slit hole that is formed to extend along the longitudinal direction of the regulating blade and to lead to the air flow path.

2. The developing device according to claim 1, wherein the toner receiving member is provided with a wall portion that extends along a longitudinal direction of the toner receiving member and projects upward from a part of the toner receiving member closer to the toner feeding roller than the slit hole is.

3. The developing device according to claim 2, wherein a surface of the wall portion, the surface facing the toner feeding roller, is inclined such that a lower part of the surface is closer to the toner feeding roller.

4. An image forming apparatus comprising:

the developing device according to claim 1; and an air suction device that sucks out air from inside the air flow path of the developing device.

* * * * *